US006133519A

United States Patent [19]

Mair

[11] Patent Number: 6,133,519

[45] Date of Patent: Oct. 17, 2000

[54] PIANO HUMIDITY CONTROL SYSTEM HAVING MOISTURE IMPERMEABLE BACK OR BOTTOM COVER

[75] Inventor: Robert W. Mair, Asheville, N.C.

[73] Assignee: Dampp-Chaser Electronics Corporation, Hendersonville, N.C.

[21] Appl. No.: 09/041,586

[22] Filed: Mar. 12, 1998

[51] Int. Cl.[7] ..... G10D 1/02

[52] U.S. Cl. ..... 84/453; 84/275

[58] Field of Search ..... 84/453, 275; 237/78; 239/51.5, 57

[56] References Cited

U.S. PATENT DOCUMENTS

| | | | |
|---|---|---|---|
| 375,491 | 12/1887 | Ivers | 84/174 |
| 1,033,536 | 7/1912 | Canfield | 84/453 |
| 1,650,004 | 11/1927 | Billings | 84/453 |
| 3,664,579 | 5/1972 | Foote | 236/44 |
| 3,672,568 | 6/1972 | Foote | 236/44 |
| 3,719,033 | 3/1973 | Den Boer | 55/387 |
| 4,150,372 | 4/1979 | Foote | 340/620 |
| 4,423,658 | 1/1984 | Foote | 236/44 |
| 4,572,051 | 2/1986 | Laskin | 84/453 |
| 4,649,793 | 3/1987 | Blackshear et al. | 84/453 |
| 5,289,751 | 3/1994 | Light | 84/275 |
| 5,456,742 | 10/1995 | Glenn et al. | 96/26 |

OTHER PUBLICATIONS

Dampp–Chaser Newsletter, Dampp–Chaser Electronics Corporation, Hendersonville, North Carolina, Jun. 19, 1997.

*Instructions for the Installation of a BSV11PS in a Vertical Piano*, Dampp–Chaser Electronics Corporation Oct. 1994.

*Additional Instructions Relating to the Mylar Cover*, Dampp–Chaser Electronics Corporation Jun. 1996.

*Primary Examiner*—Robert E. Nappi
*Assistant Examiner*—Kimberly Lockett
*Attorney, Agent, or Firm*—Carter & Schnedler, P.A.

[57] ABSTRACT

There is provided a humidity controlled piano including a housing containing piano sound board. The housing further contains humidifier and dehumidifier apparatus. The housing includes a partial enclosure formed by a substantially rigid top and sides. The rigid enclosure has an open end. A moisture impervious aperture free sheet substantially covers the open end so that the relative humidity within the housing may be controlled.

15 Claims, 8 Drawing Sheets

PIANO HUMIDITY CONTROL SYSTEM HAVING MOISTURE IMPERMEABLE BACK OR BOTTOM COVER

BACKGROUND OF THE INVENTION

This invention relates to pianos. More particularly, it relates to apparatus for controlling the humidity inside pianos.

Changes in relative humidity adversely affects pianos, particularly, due to swelling and contraction of the piano sound board. In geographical regions where humidity swings are substantial, such as, for example, between 20% and 75% relative humidity, pianos which do not have humidity control apparatus must be tuned often, e.g., every few weeks, in order for the pianos to perform properly. In addition, the swelling and contraction of the sound board and other wood parts over time will result in a deterioration of the structural integrity of the entire piano. Thus it is desirable to maintain stabile relative humidity inside of the piano, notwithstanding, swings in relative humidity outside of the piano.

Dampp-Chaser Electronics Corporation ("Dampp-Chaser"), assignee of the present invention, is the leading manufacturer of piano humidity control systems. Dampp-Chaser manufactures piano humidifiers, dehumidifiers and humidistats which are used to control the relative humidity inside of the piano. Examples of Dampp-Chaser's humidity control systems are set forth in its U.S. Pat. Nos. 4,150,372 and 4,423,658, which patents are hereby incorporated herein by reference.

In general, the Dampp-Chaser humidity control apparatus is placed inside of the piano normally adjacent to the sound board and is used in both upright and grand pianos. When humidity is high, the humidistat turns on the dehumidifier and when humidity is low the humidistat turns on the humidifier.

In a few instances, Dampp-Chaser has recommended to its customers that the back of a limited number of pianos, in the case of an upright piano, and the bottom of the piano, in the case of a grand piano, be covered with a sheet made of MYLAR or felt having a plurality of apertures or holes therein, and have provided the materials necessary to accomplish this. It was believed that the holes in the cover were needed to exhaust air with high moisture concentrations from the inside of the piano to the outside of the piano when the dehumidifier was operating and to eliminate the possibility of condensation inside of the piano when the humidifier was operating. In addition, the holes were thought to facilitate the movement of air necessary for the production and the distribution of moist and dry air.

By using the Dampp-Chaser humidification/dehumidification system together with a cover having holes therein, Dampp-Chaser has been able to achieve relative humidity stability inside the piano such that the moisture content of the sound board varied by only 1¾% to 2% when the relative humidity outside of the piano varied between approximately 24% to approximately 70%. While this system has greatly lessened the need to tune the piano frequently, and has resulted in increased structural integrity of the piano, better results are desirable.

OBJECTS OF THE INVENTION

It is therefore one object of this invention to provide an improved piano humidification/dehumidification system.

It is another object of this invention to provide a piano which has a humidity stable sound board.

It is still another object of this invention to insure that the structural integrity of the piano is maintained.

It is yet another object of this invention to provide a piano having highly stable internal relative humidity and corresponding moisture content using a system which is inexpensive, easy to install and easy to use.

SUMMARY OF THE INVENTION

In accordance with one form of this invention, there is provided a humidity controlled piano including a housing containing piano sound board. The housing also contains humidifier and dehumidifier apparatus. The housing includes a partial enclosure formed by a substantially rigid top and sides. The rigid enclosure has an open end which, in the case of an upright piano is the back, and in the case of a grand piano is the bottom.

The open end is substantially covered by a moisture impervious substantially aperture free sheet so that the relative humidity within the housing may be controlled. Preferably, the open end is defined by a frame structure and the sheet is attached to the frame structure.

Also, preferably, the humidifier and dehumidifier apparatus is located adjacent to the piano sound board. In some instances, the piano humidifier and dehumidifier apparatus may be located between the piano sound board and the sheet, and in other instances, the humidifier and dehumidifier apparatus is located on the opposite side of the sound board.

By using apparatus of the subject invention, the moisture content of the sound board has been shown to deviate less than 1% when the relative humidity outside of the piano varies up to 50%.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENTS

Figure 1:
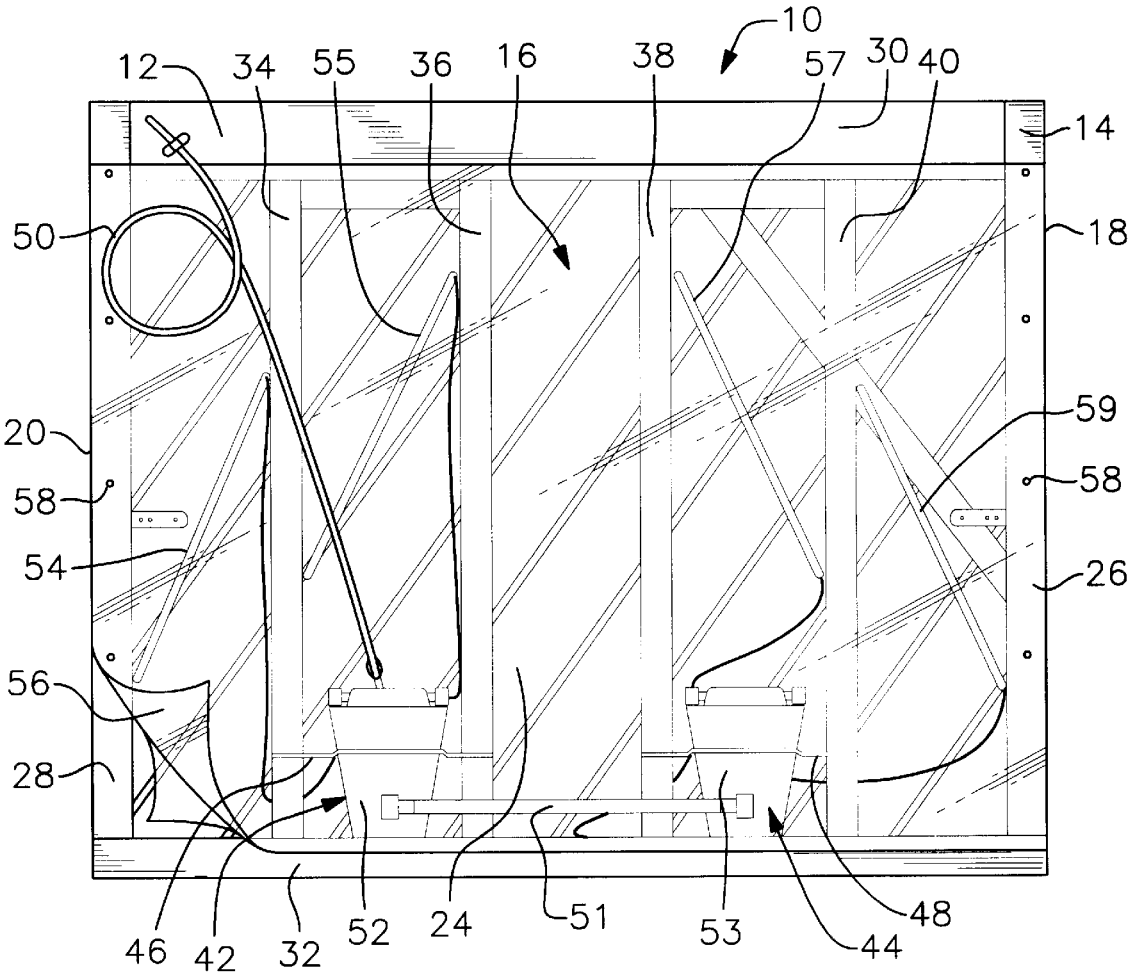
FIG. 1 is a rear elevational view of an upright piano illustrating one embodiment of the subject invention.

Referring now more particularly to FIG. 1, there is provided upright piano 10, the back side of which is illustrated. Piano 10 includes housing 14 forming enclosure 16. The housing 14 includes rigid sides 18 and 20 and a rigid front 22 which is illustrated in FIG. 3.

The back side of the piano is open forming opening 12 with opening 12 being framed by side boards 26 and 28, top board 30 and a bottom board 32.

Figure 3:
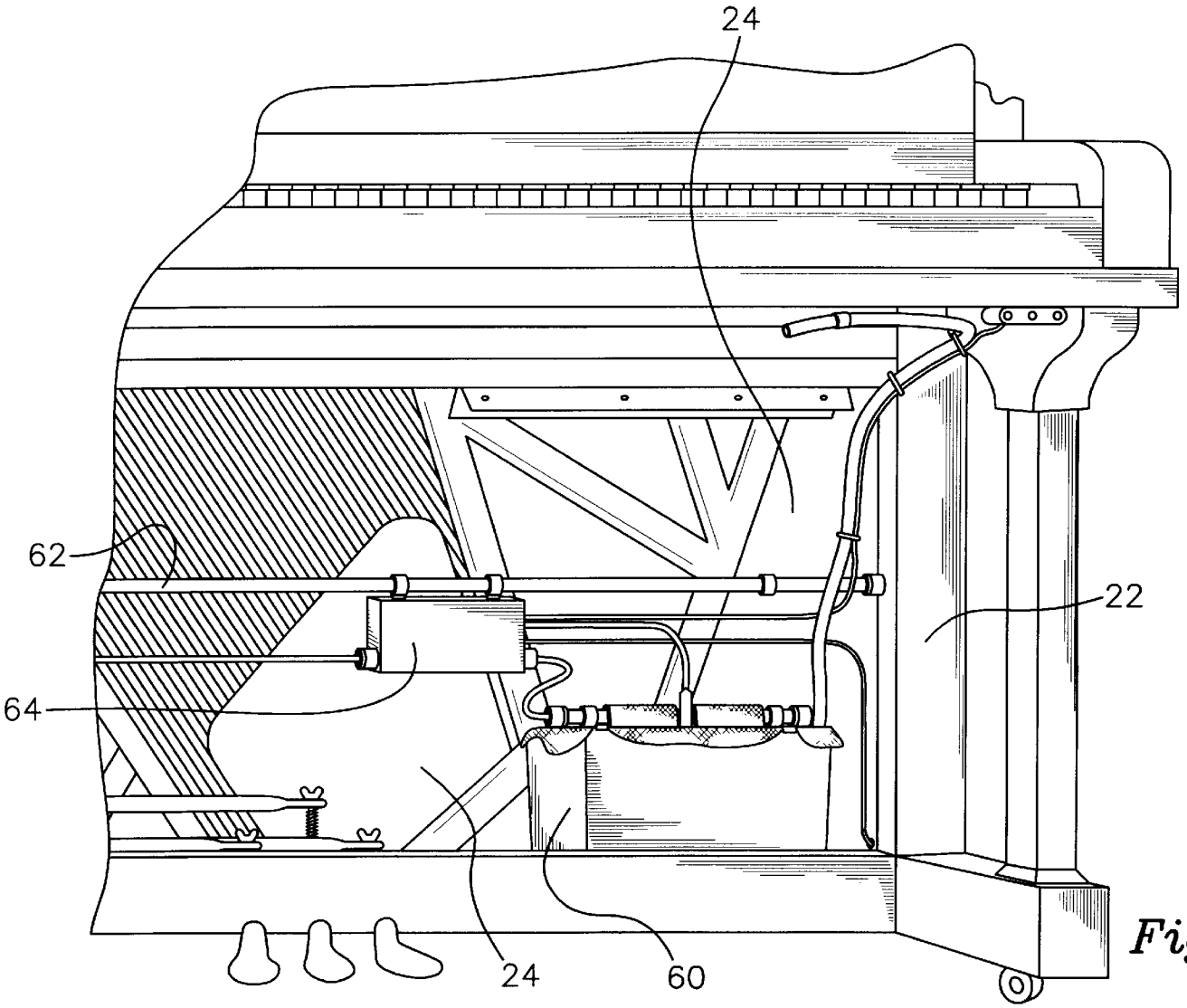
FIG. 3 is a partial front view of an upright piano with the kick board having been removed to illustrate an alternative position for humidification/dehumidification apparatus.

As illustrated in FIGS. 1 and 3, piano sound board 24 is received within enclosure 16. A plurality of supporting struts 34, 36, 38 and 40 are situated between top board 30 and bottom board 32 to provide structural support for the piano.

Humidifiers 42 and 44 are placed adjacent to sound board 24. Humidifier 42 is secured between support struts 34 at 36 by strap 46. Humidifier 44 is secured between support struts 38 and 40 by strap 48.

Fill tube 50 is used to permit the user to add water to container 52 which forms a part of humidifier 42. Container 53 of humidifier 44 is filled by means of tube 51 which connects container 52 to container 53.

The preferred humidifier is a Model HM1 commercially available from Dampp-Chaser.

Dehumidifiers 54, 55, 57 and 59 are also located adjacent to sound board 24. The dehumidifiers are secured to upright beams, such as beams 36 and 38 for dehumidifier 55. The preferred dehumidifier is a Model 24-25 commercially available from Dampp-Chaser.

A humidistat 64, shown in FIG. 3, is used to control the operation of the humidifiers 42 and 44 and the dehumidifiers 54, 55, 57 and 59. That is, when the humidity inside of enclosure 16 goes below a predetermined level, such as, for example, 40% relative humidity, humidifiers 42 and 44 are turned on to add humidity to the enclosure. However, when the humidity rises above a certain level, such as, for example, 50% relative humidity, dehumidifiers 54, 55, 57 and 59 are turned on to lower the humidity.

Figure 4:
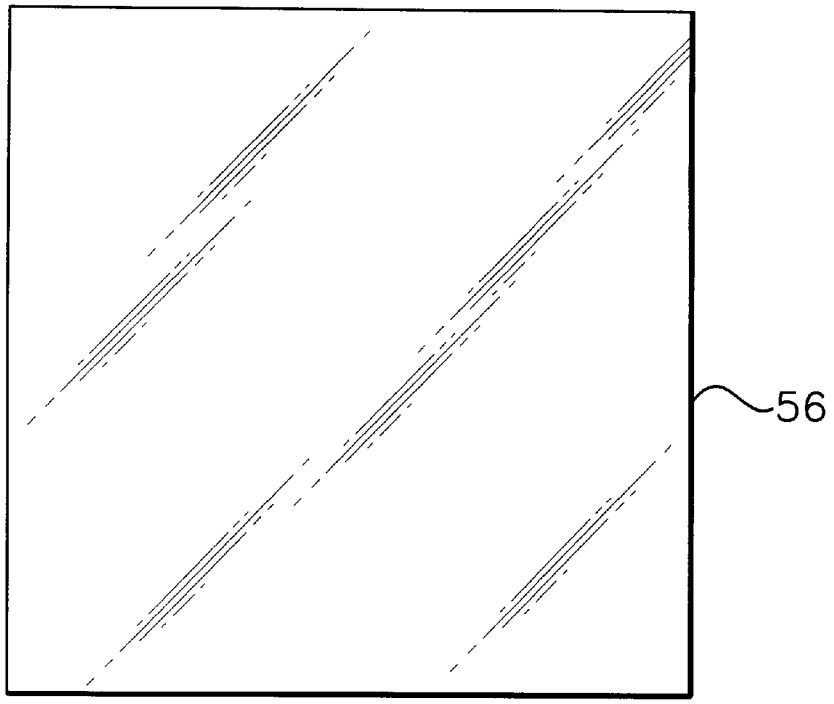
FIG. 4 is a plan view of a transparent plastic moisture impervious plastic sheet which is preferably used with an upright piano in accordance with the teachings of the subject invention.

The opening 12 is covered completely by a moisture impervious aperture free clear plastic sheet 56, an example of which is illustrated in FIG. 4. Preferably, plastic sheet 56 is made of polyethylene terephthalate, such as MYLAR, or polypropylene. The edges of sheet 56 are attached to the frame formed by boards 26, 28, 30 and 32 by closely spaced push pins 58. The plastic sheet substantially prevents moisture from entering or exiting enclosure 16 through the opening in back side 12.

Referring now to FIG. 3, which shows an alternative embodiment to FIG. 1, the humidifier 60 is placed adjacent to sound board 24, however, it is located between the sound board and the kick board, which is on the front of the piano and which has been removed for illustrative purposes. In addition, dehumidifier 62 is mounted above humidifier 60 and adjacent to sound board 24. Humidistat 64 is connected to humidifier 60 and to dehumidifier 62 to control them.

Figure 2:
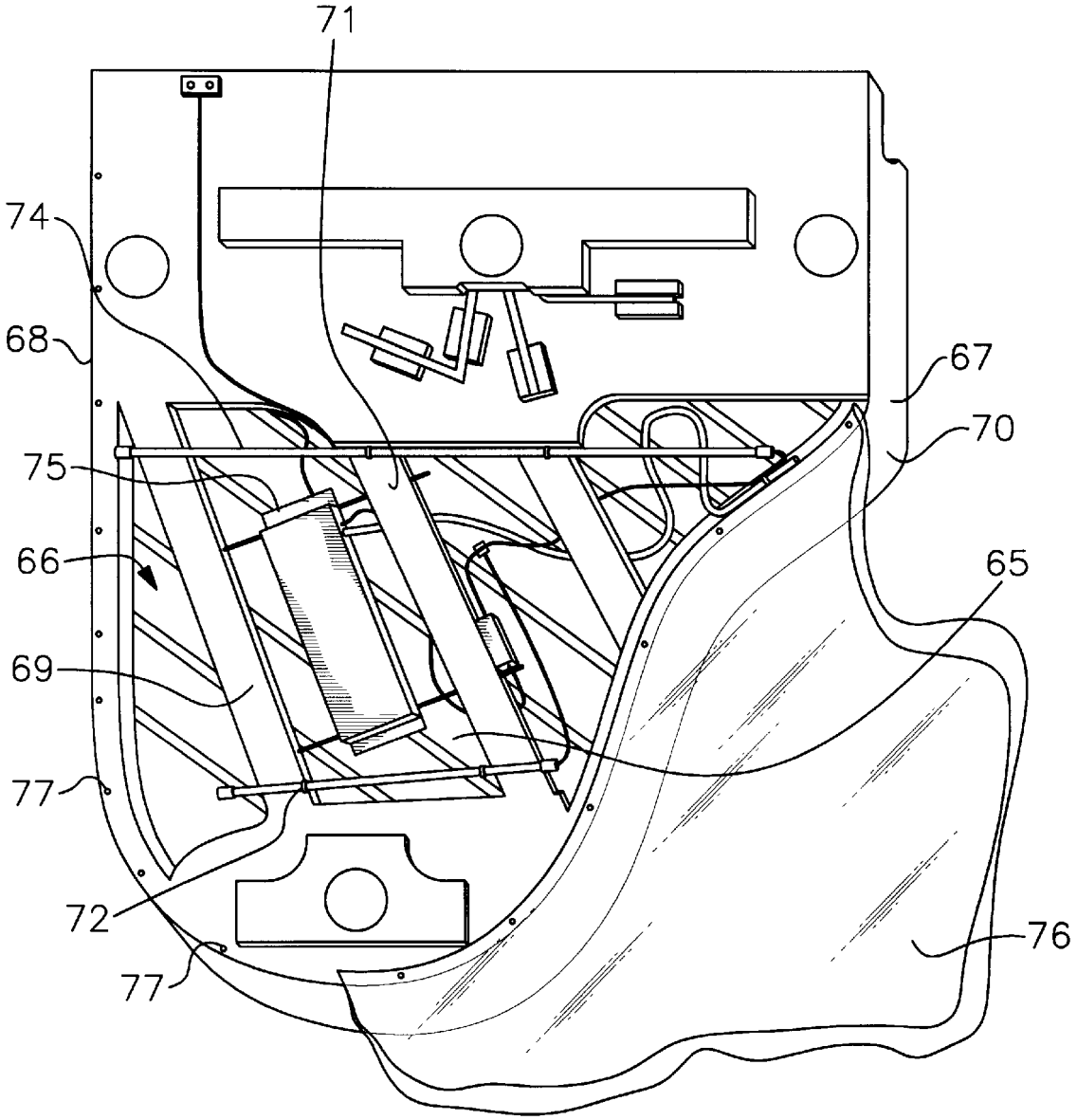
FIG. 2 is a bottom view of a grand piano illustrating another embodiment of the subject invention with the moisture impervious sheet having been partially removed and folded back for illustrative purposes.

Referring now more particularly to FIG. 2, there is provided the grand piano version of the subject invention. FIG. 2 shows the bottom 66 of grand piano 67. The bottom 66 is open. Closed sides 68 and 70 and sound board 65 form a partial enclosure.

Dehumidifier 72 is also located near sound board 65 and is attached to support beams 69 and 71. A second dehumidifier 74 is also attached to the support beams. Humidifier 75 is located adjacent to sound board 65 and is also attached to support beams 69 and 71.

Figure 5:
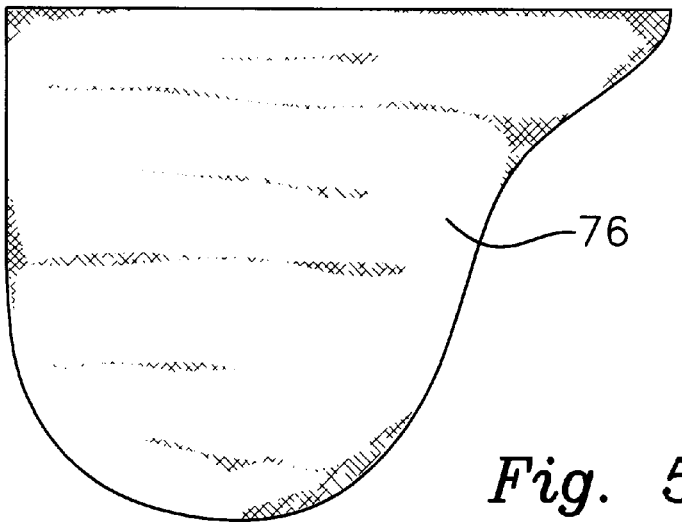
FIG. 5 is a plan view of a moisture impervious felt sheet which is preferably used with a grand piano in accordance with the teachings of the subject invention.

In the grand piano version, the impervious sheet 76 which covers the entire open bottom 66 of the piano may be in the form of an aperture free plastic cover, as illustrated in FIG. 5, which has been cut in the shape of the bottom of the grand piano. The sheet 76, shown in FIG. 2, has been partially folded back to illustrate the location of the humidification/dehumidification devices adjacent to the sound board. The felt sheet is secured to the bottom of the grand piano by closely spaced push pins 77.

By using humidity controls and a moisture impervious sheet on the back of a piano, in the case of an upright piano, and on the bottom of a piano in the case of a grand piano, it has been found that the piano stays closely in tune for a substantial period of time, as compared to prior art systems, and represents a substantial improvement over prior art systems. And in addition, the structural integrity of the piano is enhanced because the expansions and contractions of the sound board and other connected wood parts are practically eliminated in view of the highly stabilized moisture content.

Tests have been conducted comparing humidity variations on the sound board using the apparatus of the subject invention and prior art designs. The results of the tests are discussed below.

| SYSTEM | POWER & LOCATION | BACK COVER | % SOUNDBOARD MOISTURE CONTENTS FOR OUTSIDE RH APPROXIMATELY BETWEEN 72% & 21% | % SWING FROM WET TO DRY |
|---|---|---|---|---|
| 5PS | 25 W front | none | 9 1/16–6 3/4 | 2 5/16 |
| Disklavier | 100 W back | yes-with holes | 8 3/4–6 3/4 | 2 |
| BSV11PS | 115 W back & front | yes-with holes | 8 1/2–6 3/4 | 1 3/4 |
| Ultra | 115 W back & front | yes-w/o holes | 8 1/8–7 1/8 | 1 |
| 50 W standard | 50 W front | yes-w/o holes | 8 1/16–7 15/16 | 15/16 |
| BSV11PS | 115 W back & front | yes-w/o holes | 8 1/8–7 15/16 | 3/16 |
| No humidity control no back cover | | | 10 3/4–5 | 5 3/4 |

Figure 6:
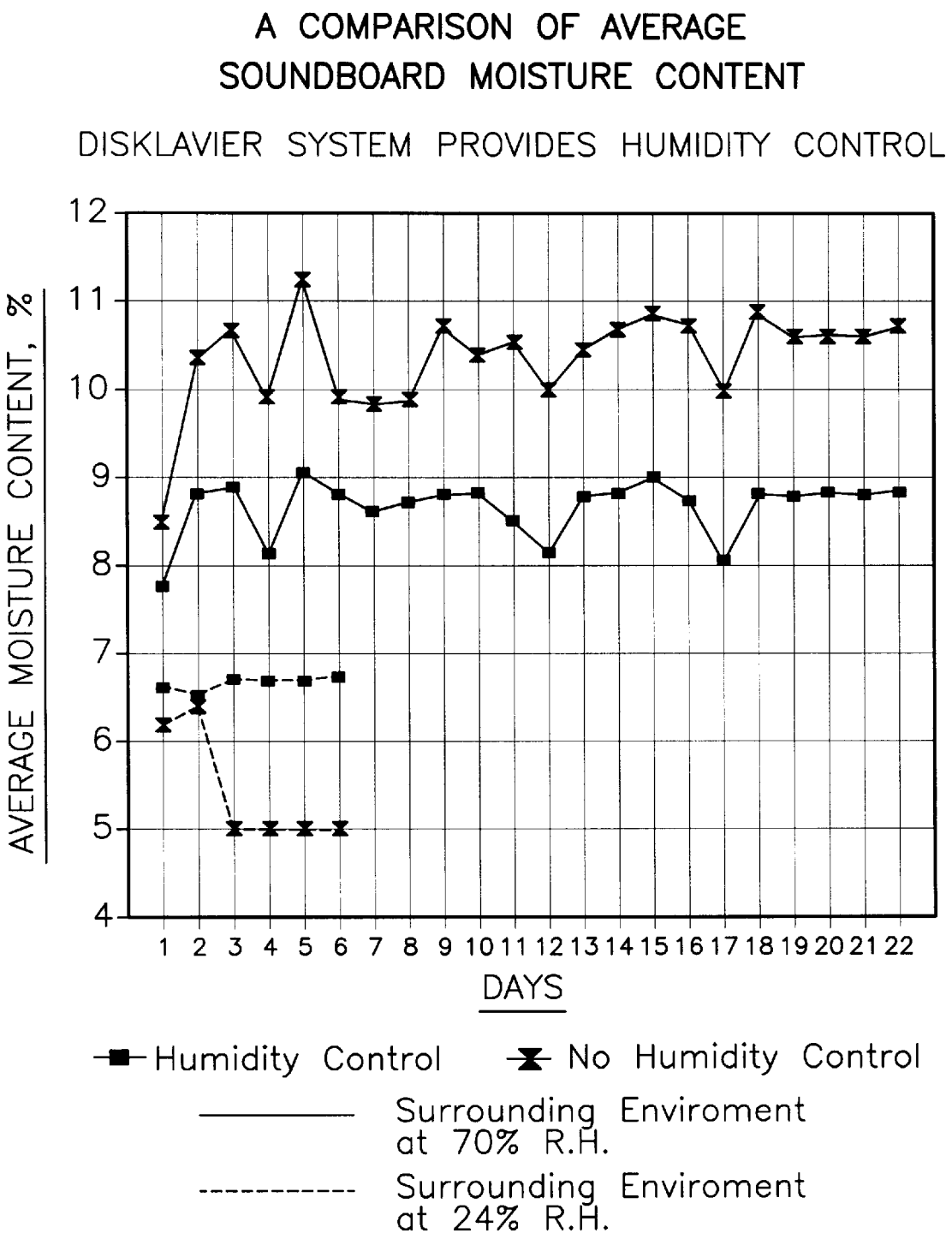
Fig. 6 Prior Art
FIG. 6 is a graph showing data taken using a prior art humidity control system for an upright piano.

FIG. 6 is a graph illustrating a test of a Disklavier system with and without humidity control apparatus using a cover with holes, and thus, is a prior art system. The upright piano had a MYLAR cover having a plurality of holes. The moisture content swing on the sound board using this system with humidity controls was between an average of 8¾% to 6¾%, which is a swing of 2% in moisture content where the outside environment was at 24% relative humidity and 70% relative humidity. Without humidity controls, the swings were much greater.

Figure 7:
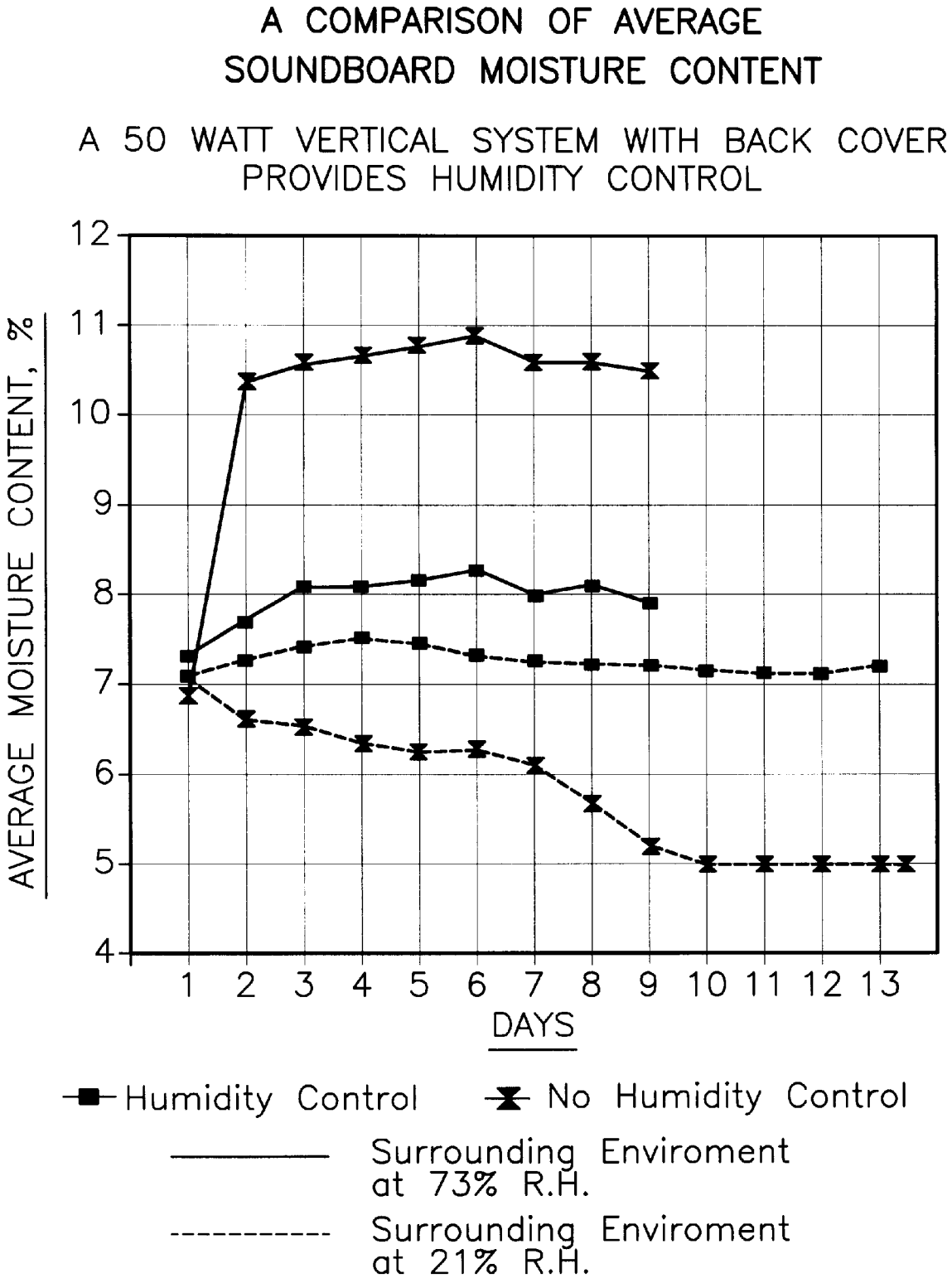
FIG. 7 is a graph showing data taken using a humidity control system of the subject invention for an upright piano.

FIG. 7 is a graph illustrating the performance of a system utilizing the subject invention in an upright piano, such as one shown in FIG. 1. The data points in FIG. 7 were taken with a surrounding environment at 21% relative humidity and at 73% relative humidity. The back cover did not have holes, except for a hole occupied by a portion of the fill tube. The moisture content swings with this system and using humidity controls was between an average of 8 1/16%–7⅛%, which represents a swing of 15/16%. Thus the subject invention represents approximately a 50% improvement over the prior art, which is highly significant.

Figure 8:
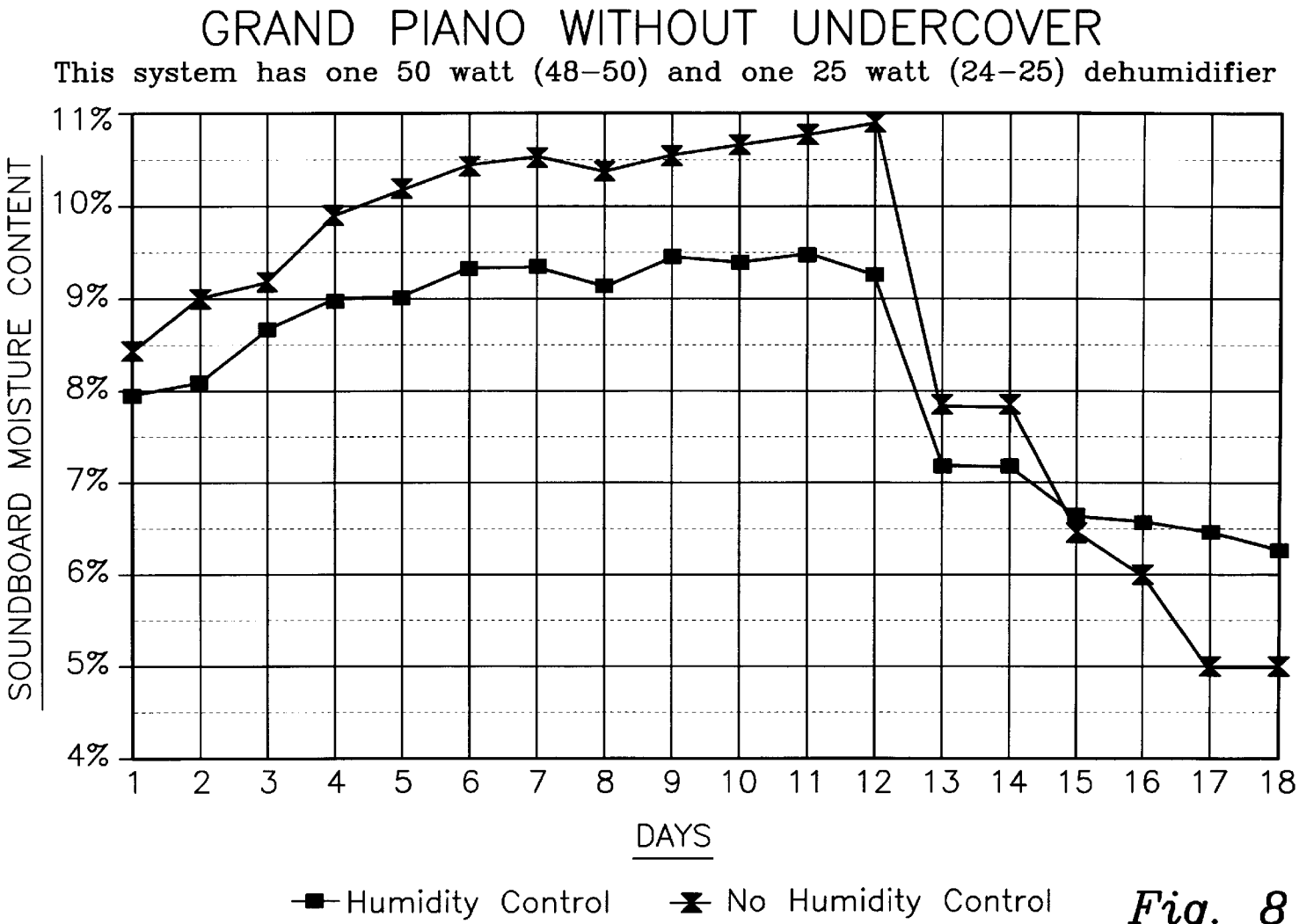
Fig. 8 Prior Art
FIG. 8 is a graph showing data taken using a prior art humidity control system for a grand piano.

Tests were also conducted utilizing a grand piano. FIG. 8 shows data taken using a grand piano that had no undercover, and thus is prior art, but had a humidity control system similar to the one shown in FIG. 2. With the outside relative humidity varying between 72% and 21%, the moisture content swing of the sound board from wet to dry was 9½% to 6¼%, or a 3¼% swing, as illustrated in FIG. 8. It was also tested with the humidity controls turned off, and the swing was from 11% to 5%.

Figure 9:
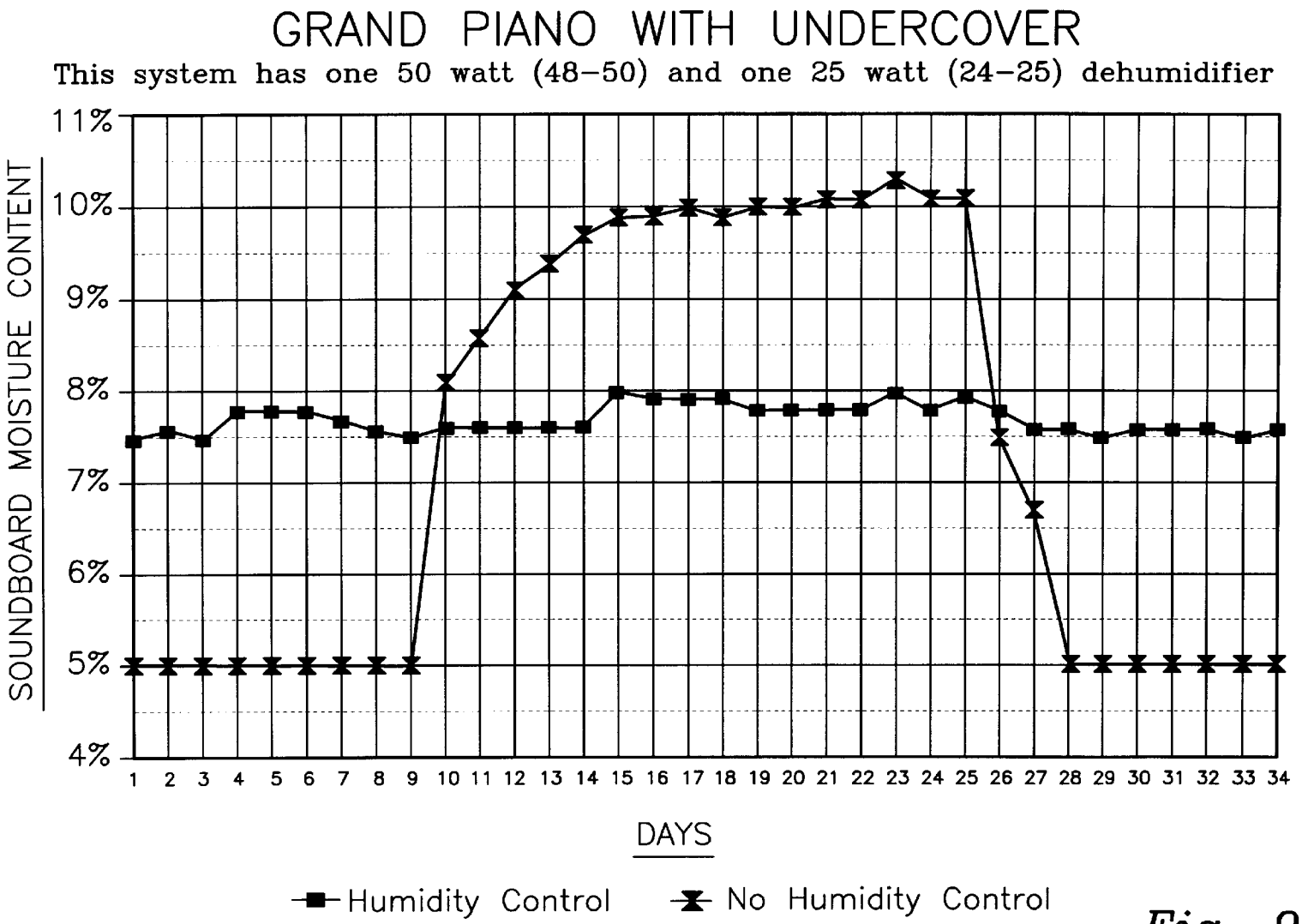
FIG. 9 is a graph showing data taken using a humidity control system of the subject invention for a grand piano.

FIG. 9 shows test data taken where the subject invention shown in FIG. 2 was utilized, namely a felt cover on the entire bottom of the grand piano. With humidity controls utilized, as shown in FIG. 2, the moisture in the sound board varied only between 7½% to 8% with a 72% to 21% variation in outside relative humidity, and thus, a ½% swing. This represents more than a six fold improvement over a system which had no cover. Where humidity controls were not used, the swing was substantial.

Heretofore, it is believed that one should use covers on the backs and bottoms of pianos which contained a plurality of holes which was believed to aid in removing moisture from the inside of the piano when dehumidifying, and eliminating the possibility of condensation when humidifying, and in addition, facilitating air movement necessary for the production and distribution of moist and dry air. However, quite unexpectedly was it found that by using a moisture impervious cover with no apertures, a substantial improvement in humidity stability of the inside on the piano, and thus, the sound board, has been achieved.

From the foregoing description of the preferred embodiments of the invention, it will be apparent that many modifications may be made therein. It will be understood, however, that the embodiments of the invention are an exemplification of the invention only and that the invention is not limited thereto. It is to be understood, therefore, that it is intended in the appended claims to cover all modifications as fall within the true spirit and scope of the invention.

What is claimed is:

1. A humidity controlled piano comprising:

a housing; said housing containing a piano sound board; said housing further containing an apparatus for controlling humidity including a humidifier and a dehumidifier; said housing including a rigid partial enclosure formed by substantially rigid top and sides; said partial enclosure having an open end;

a substantially moisture impervious sheet means for enabling the moisture content of said sound board to change no more than one percentage point when the humidity outside of the piano varies within a range of 21% to 72% humidity; said substantially moisture impervious sheet means substantially covering said open end.

2. A piano as set forth in claim 1, wherein said open end is defined by a frame structure; said sheet being attached to said frame structure.

3. A piano as set forth in claim 1, wherein said sheet is made of plastic.

4. A piano as set forth in claim 3, wherein said sheet is made of polyethylene terephthalate.

5. A piano as set forth in claim 3, wherein said sheet is made of polypropylene.

6. A piano as set forth in claim 1, further including a sound board; said humidifier and said dehumidifier being located adjacent to said sound board.

7. A piano as set forth in claim 1, further including a humidistat located within said housing; said humidistat controlling said humidifier and said dehumidifier.

8. A piano as set forth in claim 1, wherein said open end is on the back of the piano.

9. A piano as set forth in claim 1, wherein said open end is at the bottom of the piano.

10. An assembly comprising:

a piano; said piano including a substantially rigid structure forming a partial enclosure; said piano including a sound board;

a humidity control apparatus; said humidity control apparatus received within said partial enclosure and located adjacent to said sound board;

said partial enclosure having an open side; a substantially moisture impervious sheet means for enabling the moisture content of said sound board to change no more than one percentage point when the humidity outside of the piano varies within a range of 21% to 72% relative humidity; said open side covered by said substantially moisture impervious sheet means.

11. An assembly as set forth in claim 10, wherein said humidity control apparatus is located between said sound board and said sheet.

12. An assembly as set forth in claim 10, wherein said humidity control apparatus is located on the side of said sound board which is opposite to said sheet.

13. An assembly as set forth in claim 10, wherein said sheet is plastic.

14. An assembly as set forth in claim 10, wherein said sheet is polyethylene terephalate.

15. An assembly as set forth in claim 10, wherein said sheet is polypropylene.

* * * * *